US005351456A

United States Patent [19]

Paine, Jr.

[11] Patent Number: 5,351,456

[45] Date of Patent: Oct. 4, 1994

[54] CONCRETE FORM TIE WEDGE

[75] Inventor: John R. Paine, Jr., Centerville, Ohio

[73] Assignee: Dayton Superior Corporation, Miamisburg, Ohio

[21] Appl. No.: 6,840

[22] Filed: Jan. 21, 1993

[51] Int. Cl.[5] ..... E04B 1/38

[52] U.S. Cl. ..... 52/426; 52/712; 52/713; 249/213; 249/46; 411/523; 411/85

[58] Field of Search ..... 249/219.1, 219.2, 213, 249/216, 40, 46; 411/522, 523, 529, 539, 84, 85; 52/713, 712, 426

[56] References Cited

U.S. PATENT DOCUMENTS

| | | | |
|---|---|---|---|
| 2,560,518 | 7/1951 | Amesbury | 411/523 |
| 3,057,034 | 10/1962 | Helmick | 249/213 |
| 3,315,937 | 4/1967 | Eriksson | 249/46 |
| 3,376,612 | 4/1968 | Munse | 411/523 |
| 3,482,813 | 12/1969 | Wells et al. | 249/46 |
| 3,926,400 | 12/1975 | Franc | 249/46 |
| 4,708,554 | 11/1987 | Howard | 411/84 |
| 4,726,560 | 2/1988 | Dotson | 249/46 |
| 4,783,040 | 11/1988 | Lindberg et al. | 411/85 |
| 5,050,365 | 9/1991 | Edgar et al. . | |

FOREIGN PATENT DOCUMENTS

| | | | |
|---|---|---|---|
| 0712522 | 6/1965 | Canada | 249/46 |

*Primary Examiner*—Carl D. Friedman
*Assistant Examiner*—Wynn E. Wood
*Attorney, Agent, or Firm*—Biebel & French

[57] ABSTRACT

A wedge for use with tie rods in maintaining a predetermined spaced relation between opposed forms prior to and during the pouring of a concrete wall in the space between the forms incorporates a ramp portion which includes an elongated keyhole slot for receiving a tie rod therethrough, and the portions of the ramp bordering this slot are especially formed to reinforce them against deflection or collapse under the loading applied thereto from the head of a snap tie rod supported thereon and also to provide concave self centering capability and smooth surfaces to avoid nicking.

8 Claims, 2 Drawing Sheets

FIG-1
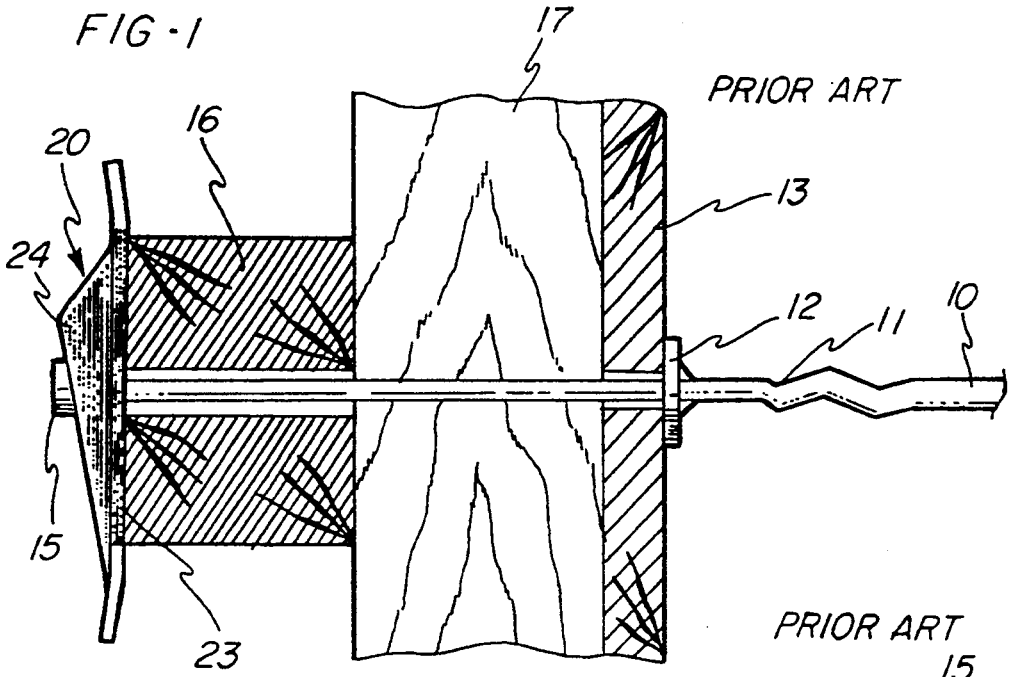
PRIOR ART
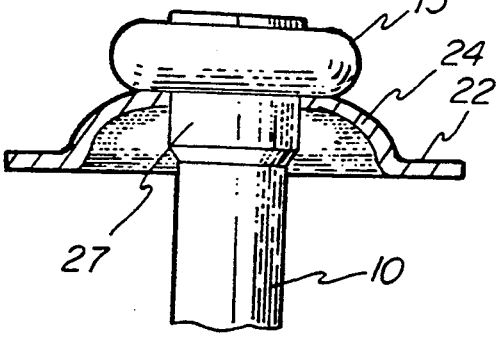
FIG-3
FIG-2
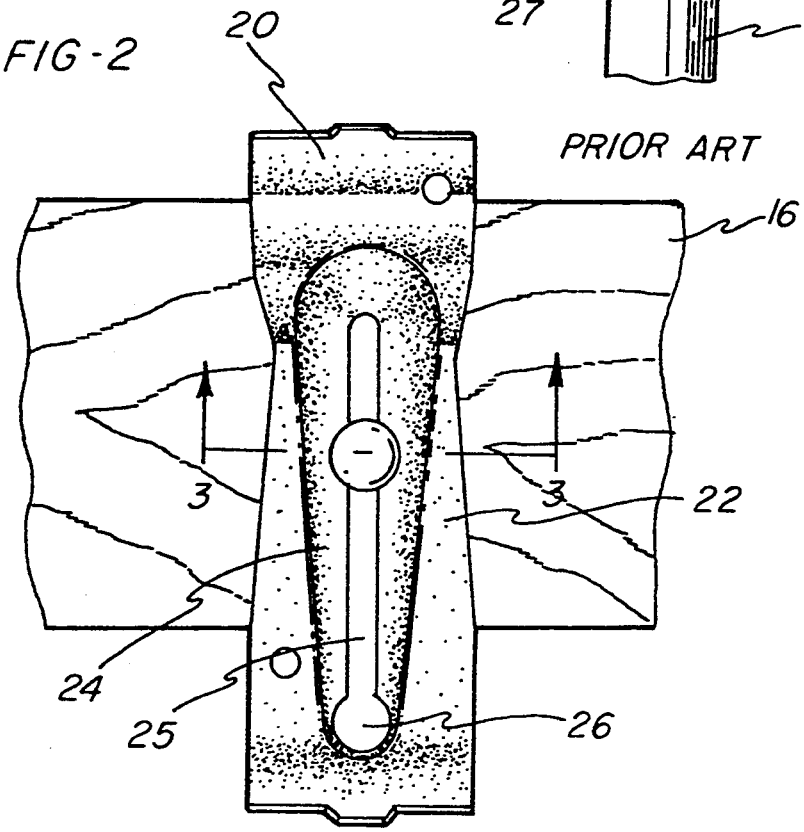

CONCRETE FORM TIE WEDGE

BACKGROUND OF THE INVENTION

This invention relates to wedges for use with ties in maintaining a predetermined spaced relation between opposed forms prior to and during the pouring of a concrete wall in the space between the forms. The invention is particularly concerned with wedges for use with form ties which are designed to have their outer end portions broken off inside the wall after the concrete has set and the forms have been removed.

In one conventional use of such ties, they may have a shoulder or other spacer adjacent to each end thereof which butts the inner surface of a form. The end portion of the tie beyond this spacer passes through a hole in the form and has a head on its outermost end which cooperates with clamping means and reinforcing lumber ("forms") to brace the assembled formwork against the internal hydraulic pressure developed while the fluid concrete fills the space between the forms.

The co-owned Edgar et al U.S. Pat. No. 5,050,365 of 1991 describes a problem affecting the utility of such ties of the then conventional construction arising from the fact that during erection of the forms and their supporting lumber, the mechanical connection between the head of each tie and an adjacent wale is provided by a wedge designed to apply tension to the end portion of each tie between each head and the spacer which engages the inner face of the adjacent form.

That problem was that with conventional ties and associated wedges, instead of maintaining essentially axially directed tension on the end portions of each rod, forces were developed which caused twisting of one or both of the rod heads where they interconnected with the remainder of the rod. These twisting forces were sometimes so severe as to cause the head of the rod to snap off and thus render the rod inoperative for the purpose for which it was intended.

In accordance with the Edgar patent, the problem and effect on conventional ties as outlined above were eliminated by a novel construction of each tie wherein a portion of the tie where each head interconnects with the rod is of larger cross-sectional dimensions than the remainder of the rod, although less than those of the head. The resulting reinforcement of the interconnection between the head and the rod overcame any tendency to premature snapping of the rod at its junction with a head.

In the use of the ties of the Edgar patent, however, it was found that the new ties so successfully resisted the forces previously causing conventional ties to break prematurely that the effect of those forces was transferred to the wedges of conventional construction. For example, wedges of the configuration shown in the above Edgar patent which were formed of sheet steel of an accepted thickness tended to buckle or collapse.

More specifically, the conventional wedge was formed of sheet metal of uniform thickness with an elongated slot through which the head and adjacent portion of a rod projected, and the tensioning force of the wedge was applied to the rod by engagement between the sloping sides of the slot and the axially inner end of the rod head. The problem was that the portion of the wedge along each side of the slot would tend to collapse, usually sequentially rather than simultaneously, but either way, the result was to lose the tension on the rod and thus permit undesired outward bowing of the adjacent portion of the form while the concrete wall was being poured or had not yet set beyond an essentially fluid condition.

SUMMARY OF THE INVENTION

In accordance with the present invention, these problems have been successfully overcome by wedges of sheet steel generally of the same outline as the previous conventional wedges, but the ramp portion which performs the wedge function is specially formed to reinforce it against deflection and deformation in use.

More specifically, the ramp portion of the wedge includes an elongated keyhole slot for receiving a snap tie therethrough, and the portions of the ramp bordering this slot are especially formed to reinforce them against deflection or collapse under the loading applied thereto from the head of a tie supported thereon.

Thus in the preferred embodiment of the invention illustrated in the drawing and described hereinafter, the portions of the wedge ramp bordering the slot which receives a snap tie therethrough are formed inwardly to provide increased thickness of material aligned with the tie, smooth surfaces to reduce stress and concave sides for self centering capability. In addition, the portions of the ramp contiguous with these rim portions are rounded as viewed in section across the slot to supplement the reinforcing action of the rim portions.

BRIEF DESCRIPTION OF THE DRAWINGS

FIG. 1 is a fragmentary section through one side of erected formwork which includes a snap tie, wedge and reinforcing lumber according to conventional prior practice;

FIG. 2 is an elevation looking from left to right in FIG. 1;

FIG. 3 is a section on the line 3—3 in FIG. 2;

DESCRIPTION OF THE PREFERRED EMBODIMENT

Figure 4:
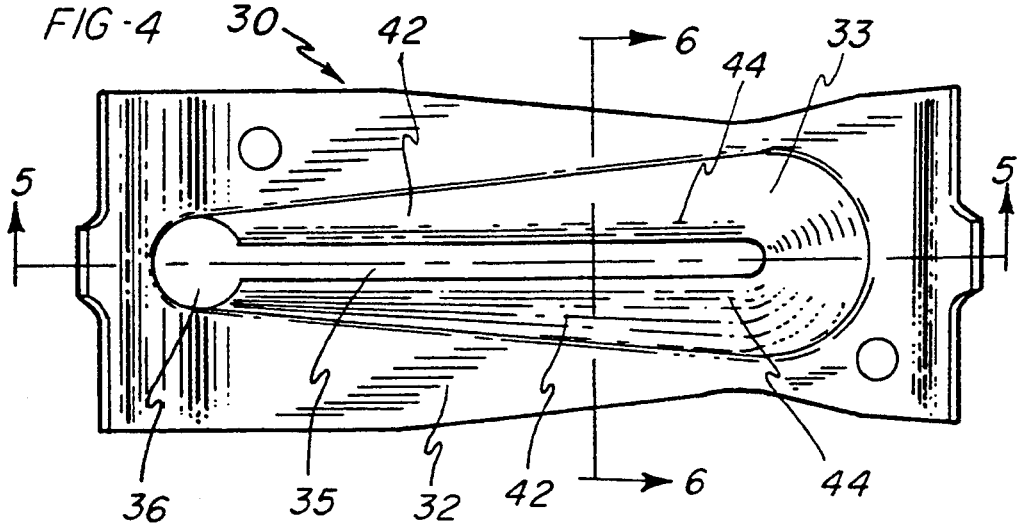
FIG. 4 is a front elevation of a wedge constructed in accordance with the present invention.

The steel tie rod tie 10 illustrated in FIGS. 1–3 is of the construction disclosed and claimed in the above Edgar patent. It has a weakened portion 11 where it is intended to be snapped after the wall has been completed, and which is inboard of the spacer 12 that abuts the inner surface of the form 13 in the assembled formwork. The remainder of the rod outboard of the spacer 12 has a head 15 which cooperates with a wedge 20 to clamp the reinforcing wales 16 and 17 against the outer face of the form 13, and this structure is duplicated at the other end of the tie and the formwork associated therewith.

The wedge 20 is of a conventional construction formed of sheet steel of uniform nominal thickness of 0.120 and it includes an essentially flat peripheral portion 22 which defines a plane and has a back surface 23 adapted to engage the outer wale 16. The portion 22 surrounds a central ramp portion 24 provided with an elongated slot 25 slightly wider than the cross-section of tie 10 and which includes at its lower end an enlarged portion 26 of sufficient size to receive the rod head 15 in a slip fit therethrough. In the use of this wedge, after it has been slipped over the head of the rod, it is driven lengthwise of slot 25 while the rod head 15 climbs the ramp 24 to develop the desired tension in the rod which holds the several parts of the formwork in the desired relationship.

During this assembly action, the sloping sides of the wedge slot 25 will initially tend to cause the head of the tie to bend away from the direction of its travel in the slot 25, i.e. downwardly as viewed in FIGS. 1 and 2. Thereafter, when the assembly of multiple ties and wedges is required to hold the forms against the hydraulic pressure of the fluid concrete filling the space between the forms, the tension on the ties and the pressure on the wedges greatly increase.

Prior to development of the ties disclosed in the above Edgar patent, it was found in practice that on too many occasions, the wedge tended to collapse to some extent, and usually to a greater extent on one side of the slot 25 than the other. Whenever this occurred, a new force would be applied to the head end of the tie, tending to cause it to bend at right angles to the bend initially imparted thereto during assembly of the formwork. This resulted in a tendency of the rod head to snap off prematurely, with resulting undesirable effects on the uniformity of the concrete wall.

Tie rods 10 constructed in accordance with the above Edgar patent successfully overcame the tendency of conventional tie rods to break under these conditions. As shown in FIG. 2, the tie 10 includes a portion 27 interconnecting the head 15 and the body of the rod which is intermediate the diameter of the head 15 and the remainder of the body of the rod. Rods of this construction successfully resisted the tendency of rods of uniform diameter to break under the conditions described. However, when rods of this construction were used with wedges of conventional uniform thickness shown in FIGS. 1 and 3, the previously noted tendency of the wedges to collapse was found to increase.

Figure 5:
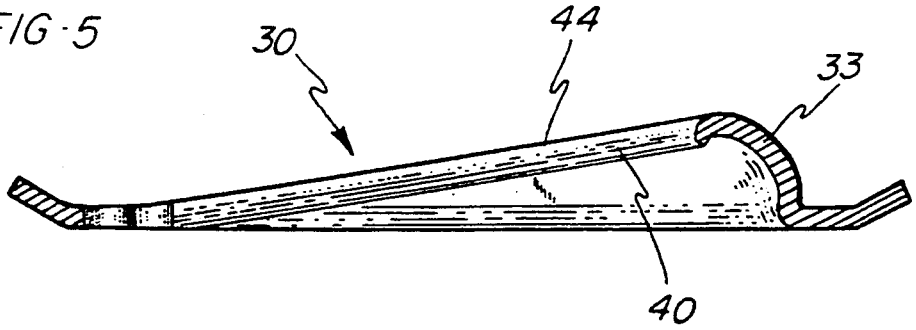
FIG. 5 is a section on the line 5—5 of FIG. 4.
Figure 6:
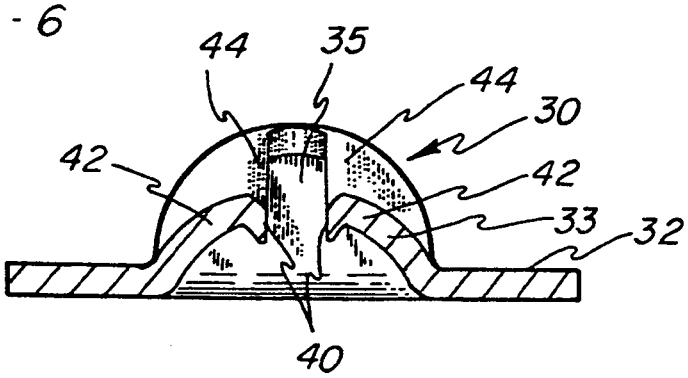
FIG. 6 is a section on the line 6—6 of FIG. 4.

Wedges of the construction shown in FIGS. 4–6 have eliminated this problem, especially when used with tie rods 10 constructed in accordance with the Edgar patent. In FIGS. 4–6, the wedge 30 may be formed with the same overall outline as the wedge 20 from sheet steel of the same thickness. It includes a peripheral portion 32 like the peripheral portion 22 of the wedge 15, and a central ramp portion 33 provided with an elongated slot 25 with a large end portion 36 which may be of the same dimensions as the slot in wedge 15.

The improvements provided by the wedge 30 over the wedge 15 are best illustrated in FIGS. 5 and 6. More specifically, in the formation of the wedge 30, after the slot 35–36 has been punched out of the flat sheet metal blank, the piece is formed in a suitable press to the desired wedge configuration. In the same forming operation, the portions of the ramp 33 bordering each side of the slot 35 are formed inwardly of the ramp to define a flanged rim 40 which is of greater extent in the direction perpendicular to the plane defined by the wedge portion 32 than the remainder of the piece.

The increased amount of metal in the rim 40 which is parallel with the direction of the forces applied to the ramp 33 by the tension developed in the associated tie rod provides substantial reinforcement against those forces, and this reinforcement is supplemented by special formation of the portion 42 of the ramp immediately adjacent each rim 40. More specifically, each of these portions is formed to a rounded, convexly curved configuration in section across the slot, as is illustrated in FIG. 6, to provide a self centering capability and the surfaces are smooth to avoid nicking of the tie.

The dimensions of these portions of the ramp are of course dependent upon the dimensions of the tie rods with which a particular size of wedge is to be used. For optimum performance, the distance between crests 44 of the rounded portions 42 should be sufficiently less than the diameter of the rod head 15 to assure that the inner surface of the rod head will extend at least slightly beyond both crests when the rod is centered in the slot 25.

As an example of satisfactory dimensional relationships, if the diameter of a tie immediately adjacent the head 15 is 0.25 inch, and the diameter of the head 15 is between 0.50 and 0.55 inch, the slot 25 may be 0.281 wide while its enlarged end portion 26 is 0.625 inch in diameter. A satisfactory dimension for the distance between the crests 44 may then be approximately 0.450 inch, which will assure that the rod head 15 will extend beyond both crests whether or not the rod is centered in the slot 25.

This means as a practical matter that in the use of the wedge and tie rod as already described, the wedge will be able to sustain any load which would cause deflection and collapse of the previous conventionally formed wedges. The invention thus assures that while the outer end of the rod will still tend to deflect downwardly in use, its deflection will be held to that direction, thereby assuring optimum performance of the combination of wedge and tie rod.

While the form of apparatus herein described constitute a preferred embodiment of this invention, it is to be understood that the invention is not limited to this precise form of apparatus, and that changes may be made therein without departing from the scope of the invention which is defined in the appended claims.

What is claimed is:

1. For use in maintaining a predetermined spaced relation between opposed forms prior to and during the pouring of a concrete wall therebetween, the combination comprising:

(a) a rod of substantially uniform section over at least the major portion of the length thereof, said rod including a head of substantially larger section than said rod on each end of said rod; and (b) a wedge including a planar portion having an opening therein which engages a supporting means for a form along a first surface and an elongated central portion formed forwardly and at an angle to a second surface of said planar portion to define a ramp, said ramp having an elongated keyhole slot therethrough of a width intermediate the width of said rod and head sections and having the lower end thereof enlarged to receive said rod head therethrough, wherein portions of said ramp bordering each side of said elongated keyhole slot are formed inwardly of said ramp to define a flanged rim which is of greater thickness in the direction perpendicular to said planar member than the remainder of said ramp;

wherein said rod head engages said wedge by extending through said opening in said planar member and said elongated slot of said ramp to engage said ramp, whereby said flanged rim braces said ramp against deflection.

2. The combination defined in claim 1, wherein the portion of said ramp contiguous with said rim on each side of said slot is rounded as viewed in section across said slot.

3. The combination of claim 2, wherein the portions of said ramp contiguous with said rim on each side of said slot are smoothly formed.

4. The combination defined in claim 2, wherein the distance between the centers of each of said rounded portions is less than the diameter of said rod head, whereby the axially inner surface of said rod head extends beyond and engages said centers of said rounded portions.

5. A wedge for use in combination with a headed tie to maintain a predetermined spaced relation between opposed forms prior to and during the pouring of a concrete wall therebetween, said wedge comprising:

(a) a planar member of substantially uniform thickness having a first surface for engagement with supporting means for a form, (b) an elongated central portion which is formed on a second surface of said planar member forwardly and at an angle with respect to said planar member to define a ramp, (c) said ramp having an elongated keyhole slot therethrough of a substantially uniform width except that the lower end thereof is enlarged to receive a tie head therethrough, and (d) portions of said ramp bordering each side of said slot are formed inwardly of said ramp to define a flanged rim which is of greater thickness in a direction perpendicular to said planar member than the remainder of said ramp and which thereby braces said ramp against deflection under operating stresses from engagement with said headed tie.

6. The wedge defined in claim 5, wherein a portion of said ramp contiguous with said rim on each side of said slot is rounded as viewed in section across said slot.

7. The wedge defined in claim 6, wherein the distance between the centers of each of said rounded portions is less than the width of said enlarged end of said slot, whereby the axially inner surface of a rod head sized to slip fit through said enlarged slot end will extend beyond and engage said centers of said rounded portions.

8. The wedge defined in claim 5, wherein portions of said ramp contiguous with said rim on each side of said slot are smoothly formed.

* * * * *